US007891296B2

(12) United States Patent
Husk et al.

(10) Patent No.: US 7,891,296 B2
(45) Date of Patent: Feb. 22, 2011

(54) CONNECTOR BLOCK FOR SHOCK TUBES, AND METHOD OF SECURING A DETONATOR THEREIN

(75) Inventors: Peter Thomas Husk, St-Lazare (CA); Ross Ian Gourlay, Vankleek Hill (CA)

(73) Assignee: Orica Explosives Technology Pty Ltd, Melbourne, Victoria (AU)

( * ) Notice: Subject to any disclaimer, the term of this patent is extended or adjusted under 35 U.S.C. 154(b) by 456 days.

(21) Appl. No.: 12/052,343

(22) Filed: Mar. 20, 2008

(65) Prior Publication Data

US 2010/0251919 A1 Oct. 7, 2010

Related U.S. Application Data

(62) Division of application No. 10/487,947, filed as application No. PCT/AU02/01234 on Sep. 6, 2002, now abandoned.

(30) Foreign Application Priority Data

Sep. 7, 2001 (CA) ..... 2357273

(51) Int. Cl.
*C06C 5/04* (2006.01)

(52) U.S. Cl. ..... 102/275.7; 102/275.12

(58) Field of Classification Search ..... 102/275.7, 102/275.1, 275.2, 275.4, 275.12
See application file for complete search history.

(56) References Cited

U.S. PATENT DOCUMENTS 3,855,934 A * 12/1974 Nett ..... 102/275.4
4,722,279 A 2/1988 Yunan
4,815,382 A 3/1989 Yunan
5,171,935 A 12/1992 Michna et al.
5,398,611 A 3/1995 Michna et al.
5,423,263 A 6/1995 Rontey et al.
5,463,955 A * 11/1995 Carriere ..... 102/275.2
5,499,581 A 3/1996 Sutula, Jr.
5,524,547 A 6/1996 Kelly et al.
5,703,320 A 12/1997 Lucca et al.
5,792,975 A 8/1998 Tseka et al.
6,305,287 B1 * 10/2001 Capers et al. ..... 102/275.7
6,349,648 B1 * 2/2002 Capers et al. ..... 102/275.4
6,513,437 B2 2/2003 Chan et al.
6,681,701 B2 1/2004 Perry
6,694,886 B1 * 2/2004 Woodall et al. ..... 102/275.1
7,188,566 B2 * 3/2007 Gladden ..... 102/275.11
7,699,004 B2 * 4/2010 Muro ..... 102/275.8
2003/0084812 A1 5/2003 Perry
2008/0257191 A1 * 10/2008 Muro ..... 102/275.11

* cited by examiner

*Primary Examiner*—Michelle Clement

(57) ABSTRACT

A method of producing an assembly of a connector block (1, 21, 40) and a detonator (5, 25, 41) suitable for retaining at least one shock tube (4, 24) adjacent to a percussion-actuation end (15, 26) of the detonator, and to an assembly thus produced and a connector block therefor. The method comprising inserting a detonator into a connector block having a housing (2, 22, 40) provided with a bore (13, 31, 44), positioning the detonator in the bore of the housing so that the percussion-actuation end of the detonator is positioned adjacent to a slot (14, 35) for receiving the shock tubes; and fixing the detonator in the housing. The detonator is fixed in the housing by causing a body of material (10) to flow plastically into the recess in the detonator and to harden therein to form a locking element fixed to the housing, thereby preventing accidental movement of the detonator within the connector block.

7 Claims, 5 Drawing Sheets

CONNECTOR BLOCK FOR SHOCK TUBES, AND METHOD OF SECURING A DETONATOR THEREIN

CROSS-REFERENCE TO RELATED APPLICATIONS

This application is a divisional of U.S. patent application Ser. No. 10/487,947 filed Sep. 16, 2004 now abandoned, which is derived from the national phase of International Patent Application PCT/AU02/01234 having an international filing date of Sep. 6, 2002 and claiming the priority right of Canadian Patent Application Serial Number 2,357,273 filed Sep. 7, 2001.

FIELD OF THE INVENTION

The present invention relates to connector blocks for the initiation of shock tubes. Connector blocks provide a means for transferring the actuation energy of a detonator to one or more shock tubes (also known as signal transmission lines) for use in the explosives industry. More particularly, the present invention relates to means and methods for securing a detonator within a connector block of this kind, and to assemblies of connector blocks with detonators pre-positioned therein.

BACKGROUND OF THE INVENTION

In commercial blasting operations, a series of explosions is frequently triggered in an exact order with precise timing. For this purpose, blasting systems have been developed that employ shock tubes also known as signal transmission lines that transfer a blast initiation signal to a series of explosive charges. To facilitate this, a signal from a single shock tube can be transferred to multiple shock tubes in a blasting system via the use of connector block/detonator assemblies, thereby permitting the initiation of multiple explosive charges in a controlled manner.

Safety and reliability are paramount for any blasting system, and efficient shock tube initiation is an important factor in this regard. Shock tubes that fail to initiate result in unexploded charges at the blast site, with inevitable safety concerns. Moreover, the reliable initiation of shock tubes is imperative to ensure the required blasting pattern is effected.

The design of the connector block has a significant influence upon the efficiency of shock tube initiation. For reliable initiation, sufficient energy must be transferred from the base charge of a detonator to the shock tubes, thus compressing the shock tubes extremely rapidly in order to initiate them. Several connector block designs, are known in the art, which have been developed to improve the efficiency of energy transfer from the base charge of the detonator to the shock tubes.

The most efficient transfer of energy from the detonator base charge to the shock tubes occurs when the surface of the percussion-actuation end of the detonator is in direct contact with the shock tubes. If any gap is present between the detonator end and the shock tubes, the transfer of actuation energy may be less efficient, thus resulting in an increased failure rate of shock tube initiation. However, excess pressure from the percussion-actuation actuation end of the detonator upon the shock tubes can result in the distortion of the shock tubes, and consequently the reduction of shock tube internal volume within the connector block. This in turn reduces the capacity of the shock tubes for efficient initiation, since their capacity for rapid compression is also reduced.

Connector blocks and their components are generally manufactured by plastic molding techniques that are well understood in the art. Quality control during the manufacturing process can ensure a degree of uniformity in the dimensions and mechanical properties of the connector blocks produced. However, slight differences between connector blocks are unavoidable due to tolerances in the plastic resulting from both the manufacturing process, and from the properties of the plastic material. Slight differences may also occur in the dimensions of the detonator. Such tolerances can give rise to improper positioning of the detonator within the connector block, relative to the shock tubes. For example, upon actuation of the detonator, a slight gap between some of the shock tubes and the percussion-actuation end can result in a reduction in energy transfer to the shock tubes.

Therefore, it is desirable to design a connector block wherein the detonator can be securely and optimally positioned to contact but not squeeze the shock tubes within the block. Previously, several attempts have been made to design connector blocks with improved reliability of shock tube initiation. However, it is important to note that previous designs generally involve the use of detonator retention means such as clips, latches, and collar locks to secure the detonator within the block. Typically, such detonator retention means employ elements that are integrally molded into the plastic of the block, or molded as a separate component. For this reason, the position of the detonator within the block is specifically governed by the position of the retention means, which locks the detonator into a fixed position relative to the shock tubes. Therefore, the distance between the retention means and the shock tubes is fixed at the point of manufacture of the connector block, and no allowance is subsequently made for tolerances in the plastic material of the block or the dimensions of the detonator.

In one example of such a device, U.S. Pat. No. 4,815,382 issued Mar. 28, 1989, discloses a connector block comprising a plastic tube having a bore, with at least one transverse bore arranged perpendicular to the main bore. The main bore is designed to receive a detonator shell, and the transverse bores can receive a length of shock tube. The detonator shell may be fixed within the connector block by means of a circumferential lip on the inside wall of the main bore, which engages a circumferential crimp at the percussion-actuation end of the detonator shell. In this way, the detonator is secured within the plastic housing of the connector block.

In another example, corresponding U.S. Pat. Nos. 5,171,935 and 5,398,611 issued Dec. 15, 1992 and Mar. 21, 1995 respectively, disclose a detonator block with a positioning means on the housing of the block, for positioning the detonator in juxtaposed signal transfer relationship with one or more shock tubes. In certain embodiments of the invention, there are also provided deformable tabs within the housing for snap-fit retention of the detonator within the connector block.

Subsequent improvements in connector block design lead to the use of collar locks for detonator retention. For example, U.S. Pat. No. 5,423,263, issued Jun. 13, 1995, discloses a connector block designed for transfer of explosive energy from the detonator for bi-directional initiation of shock tubes. In a preferred embodiment, the detonator may be held in the connector block by a collar lock device that secures the detonator at the closure crimp, present at the end of the detonator opposite the percussion-actuation end. The collar lock is slidably mounted within a groove in the block that runs perpendicular to the longitudinal axis of the detonator.

An alternative design of connector block is disclosed by U.S. Pat. No. 5,499,581, issued Mar. 19, 1996, which comprises an integral slidably mounted locking member. Once the detonator is inserted into the connector block, the locking member is displaced to rupture a frangible web and engage the closure crimp of the detonator. Moreover, the displaced locking member itself becomes locked into the displaced position by engaging the connector block. In an alternative embodiment, various shapes for the locking member are disclosed, each to secure the detonator in a fixed position relative to the shock tubes, and ensure irreversible engagement of the locking member in the displaced position.

An apparent modification to U.S. Pat. No. 5,499,581 is disclosed by U.S. Pat. No. 5,792,975, issued Aug. 11, 1998. In this regard, a similar connector block is provided comprising a slidably mounted locking member. The patent discloses an improvement in the configuration of the locking member, wherein the member comprises at least one wedge-shaped surface, so that upon displacement of the locking member towards its locking position, the wedge-shaped surface moves the detonator axially into position, adjacent to the shock tubes. In this way, the position of the detonator is biased towards the shock tubes.

As will be apparent from the discussion above, the connector blocks of the prior art frequently include complex design features to lock the detonator in a desired position. Moreover, the corresponding manufacturing processes may require several molds to produce the multiple components for the block, followed by the precise assembly of the components. It is undesirable to produce complex connector blocks for several reasons. Design complexity, and the need for multiple manufacturing steps, can result in a reduction in the quality and reliability of the connector blocks. In addition, production costs also increase with design complexity.

For practical use at the detonation site, connector blocks must be robust, reliable, and not prone to failure. The inclusion of intricate features in connector block design such as slidably mounted locking members can be detrimental to ease of handling in the field, as well as the functionality and the robustness of the blocks.

There is therefore a need for connector blocks of improved design and improved methods of manufacture of such blocks.

SUMMARY OF THE INVENTION

It is an object of the present invention, at least in preferred forms, to provide a connector block capable of securing a detonator therein without the need for complex latches, clips or displaceable members.

A further object of the present invention, at least in preferred forms, to provide a connector block that is simple to manufacture, robust and easy to handle in the field.

It is a further object of the present invention, at least in preferred forms, to provide a connector block for initiation of shock tubes, wherein a detonator can be secured therein with the percussion-actuation end of the detonator in optimal signal transfer relationship with the shock tubes.

It is another object of the invention, at least in preferred forms, to provide an assembly of a connector block for initiation of shock tubes having a detonator secured therein, with the percussion-actuation end of the detonator in signal transfer relationship with the shock tubes, and the detonator secured to virtually eliminate incorrect positioning of the detonator resulting from tolerances in the dimensions of the connector block and detonator.

It is a still further object of the invention, at least in preferred forms, to provide a connector block for securing a detonator therein for initiation of shock tubes, wherein a detonator may be secured therein with the percussion-actuation end of the detonator in optimal signal transfer relationship with the shock tubes, such that the quantity of explosive material present in the base charge of the detonator can be reduced, thereby reducing the quantity and velocity of shrapnel generated upon actuation of the detonator, and the tendency for the block to disintegrate when the detonator is initiated, especially at low temperatures.

It is yet another object of the present invention, at least in preferred forms, to provide a method for securing a detonator within a connector block of the present invention, wherein the percussion-actuation end of the detonator is positioned in optimal signal transfer relationship with shock tubes.

It is yet another object of the present invention, at least in preferred forms, to provide a method for securing a detonator within a connector block, wherein the percussion-actuation end of the detonator is positioned in optimal signal transfer relationship with shock tubes, and the potential for incorrect positioning of the detonator resulting from tolerance in the dimensions of the connector block and detonator, is virtually eliminated.

According to one aspect of the invention, there is provided a connector block and detonator assembly for retaining at least one shock tube adjacent to a percussion-actuation end of a detonator, the assembly comprising: a housing having a bore formed therein; an elongated detonator inserted in the bore, the detonator having a percussion-actuation end and an outer wall provided with an inwardly directed recess at a position remote from said percussion-actuation end; and a shock tube retention means provided on the housing at an end of the bore adjacent to the percussion-actuation end of the detonator, said shock tube retention means defining with said housing a slot for receiving at least one shock tube and holding said at least one shock tube adjacent to the percussion-actuation end of the detonator; a locking element fixed to the housing and extending into said recess for securing the detonator within the connector block in a position for initiation of the shock tubes, characterized in that said locking element is a hardened body of material caused to flow plastically into and harden within said recess after insertion of said detonator in said bore.

According to another aspect of the invention there is provided a connector block for retaining at least one shock tube adjacent to a percussion-actuation end of the detonator, the connector block comprising: a housing having a bore formed therein for receiving an elongated detonator having a percussion-actuation end and an outer wall provided with an inwardly directed recess at a position remote from said percussion-actuation end; and a shock tube retention means provided on the housing at an end of the bore adjacent to the percussion-actuation end of the detonator, said shock tube retention means defining with said housing a slot for receiving at least one shock tube and holding said at least one shock tube adjacent to the percussion-actuation end of the detonator; characterized in that said housing includes means for enabling a body of material to flow plastically into and be retained within said bore, and harden at a position corresponding to said recess in said detonator when positioned in said bore to form a locking element for securing a detonator within the connector block.

According to yet another aspect of the invention, there is provided a method of producing an assembly of a connector block and detonator suitable for retaining at least one shock tube adjacent to a percussion-actuation end of the detonator, the method comprising: inserting a detonator into a connector block, said detonator having a percussion-actuation end and an outer wall provided with an inwardly directed recess at a position remote from said percussion-actuation end, and said connector block having a housing provided with a bore for receiving said detonator, as well as a shock tube retention means provided on the housing at an end of the bore adjacent to the percussion-actuation end of the detonator, said shock tube retention means defining with said housing a slot for receiving at least one shock tube and holding said at least one shock tube adjacent to the percussion-actuation end of the detonator; positioning the detonator in the bore of said housing so that the percussion-actuation end is positioned adjacent to said slot; and fixing the detonator in the housing; characterized in that the detonator is fixed in the housing by causing a body of material to flow plastically into said recess in the detonator and to harden therein to form a locking element fixed to said housing, thereby preventing accidental movement of said detonator within said connector block.

According to still another aspect of the invention, there is provided a method for securing a detonator within a connector block in accordance with the present invention, characterized in that the method comprises the steps of: inserting a detonator into the bore of the housing; positioning the percussion-actuation end of the detonator at the signal transmission end of the bore, in a position for energy transmission from the surface of the percussion-actuation end of the detonator to the slot and the shock tubes subsequently retained therein; and molding a body of material around the recess of the detonator, to secure the detonator within the connector block.

In this way, the present invention allows a detonator to be secured within a connector block without the need for clips, latches and similar retention devices.

The term "bore" as used herein means either a hole (preferably, but not necessarily, cylindrical) running though the interior of the connector block of the present invention, or alternatively an open channel or groove formed in a side of the connector block, for the housing of a detonator therein.

The connector block of the present invention may further comprise a membrane having positioning membrane located within the bore adjacent to the signal transmission end, for accurately positioning the percussion-actuation end of the detonator in signal transfer relationship with the shock tubes located in the slot. In this manner, the present invention allows a detonator to be secured within a connector block in a position that is optimal for energy transfer from the percussion-actuation end of the detonator to the shock tubes. Importantly, any incorrect positioning of the percussion-actuation end of the detonator, resulting from any divergence in the dimensions of the connector block or detonator due to tolerance, will preferably be virtually eliminated.

In this way, the present invention discloses, in one embodiment, a method for the assembly of a detonator within a connector block, so that the percussion-actuation end of the detonator abuts the positioning membrane of a membrane within the bore, and is thereby optimally positioned for efficient energy transfer from the detonator base charge to the shock tubes. Therefore, the invention provides a method of producing a detonator/connector block assembly, wherein the detonator is optimally positioned for actuation of shock tubes, regardless of the tolerance in the connector block or detonator.

DETAILED DESCRIPTION OF THE PREFERRED EMBODIMENTS

Preferred embodiments of the present invention are described in the following with reference to the accompanying drawings.

Figure 1A:
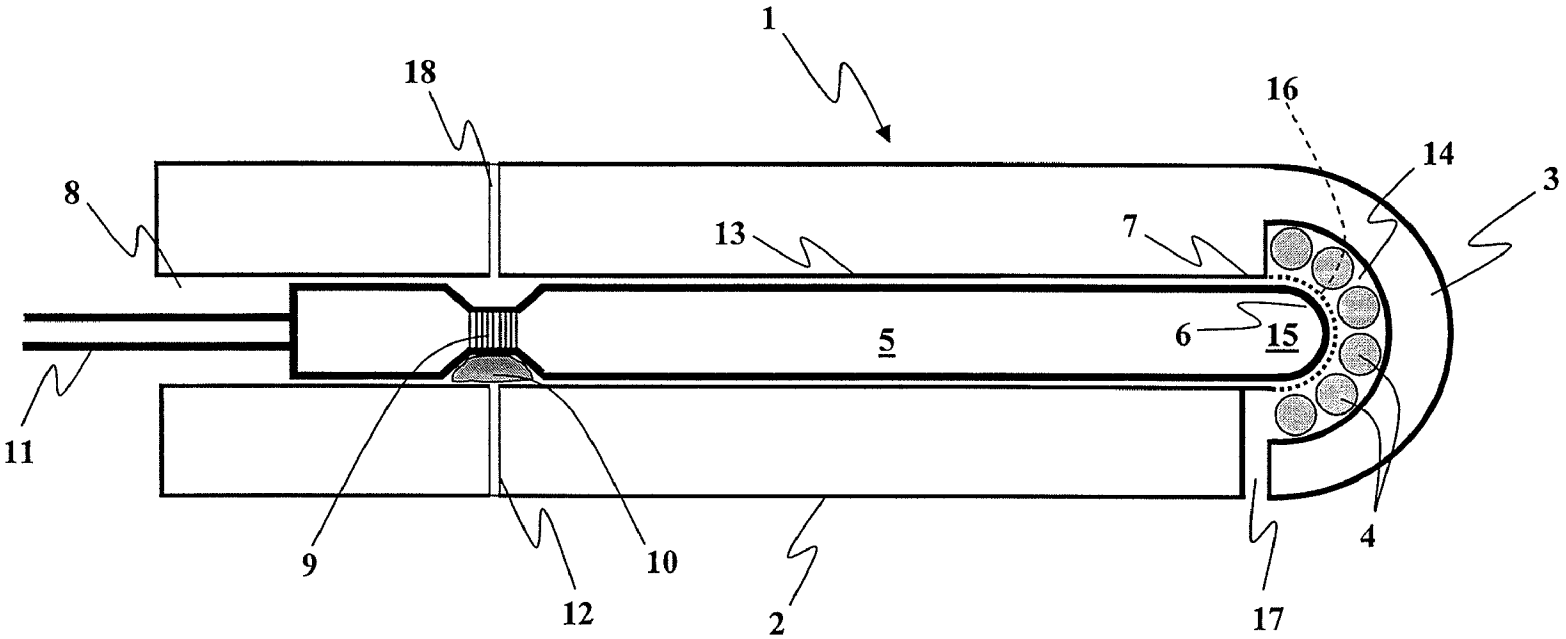
FIG. 1*a* is a cross-sectional view of a preferred embodiment of an assembly of the present invention comprising a connector block having a detonator mounted therein.

FIG. 1*a* illustrates a first preferred embodiment of the present invention, wherein a body of material in the form of a settable locking material is injected into the connector block to secure a detonator positioned therein. The connector block 1 is shown in longitudinal cross-section. The connector block comprises a housing 2, preferably made of a plastics material, with a cylindrical bore 13 running longitudinally through the housing. The bore 13 has an open end 8 and a signal transmission end 7.

While the bore 13 of all of the illustrated embodiments is formed as a cylindrical through hole, it will be appreciated by persons skilled in the art that the bore may alternatively be an open-sided slot or trough. However, a bore having a cross-section that is identical to, or closely approximates, that of a detonator to be used in the device, will be preferred.

The connector block includes a shock tube retention means in the form of an arm 3 which is integral with and extends from the housing 2 adjacent to the signal transmission end 7 of the bore 13. The arm 3 and housing 2 together define a slot 14 having an opening 17 at one side thereof.

The housing 2 is configured and dimensioned to receive a detonator 5 within the bore 13 via the open end 8 thereof. The detonator has a percussion-actuation end 15 and is orientated in the housing so that the percussion-actuated end is positioned adjacent to the signal transmission end 7 of the bore 13. Shock tubes 4 can be located in the slot 14 and arranged around and in direct contact with the percussion actuation end 15 of the detonator. Preferably, the percussion-actuation end 15 of the detonator is hemispherical, and therefore the shock tubes can be arranged equidistant from a base charge (not shown) contained within the percussion-actuation end 15 of the detonator. The use of a detonator with a hemispherical end is particularly preferred, having regard to the teachings of U.S. application Ser. No. 09/559,662.

The detonator 5 is located within the bore 13 of the housing 2 such that the surface of the percussion-actuation end of the detonator is optimally positioned relative to the position of the shock tubes 4. If desired, a positioning membrane 16 for example in the form of a thin-walled hemispherical zone may be formed partially or completely across the signal transmission end of the bore 13 for accurately locating the detonator within the connector block. Thus, the detonator may be inserted into the bore of the housing until the surface of the percussion-actuation end of the detonator 6 comes into contact with the inner surface of the positioning membrane. As shown, the positioning membrane is preferably shaped for intimate contact with the surface of the percussion-actuation end of the detonator. For example, the positioning membrane may be an open-ended spherical zone to receive a hemispherical end of a detonator. In addition, the positioning membrane is preferably configured to minimize the amount of material between the base charge of the detonator and the shock tubes contained in the slot of the connector block.

The detonator 5 is provided with a recess 9 created by an annular crimp formed in a manner known in the art. The connector block is designed so that the detonator may be secured therein by injection of a settable locking material into the recess to form a body 10 that at least partially fills the recess and either adheres to an adjacent part of an inner surface of the bore 13, or engages with a recess in the bore 13. For this purpose, the housing is provided with an opening 12, through which the settable locking material can be injected into the recess 9.

The opening 12 is positioned in the proximity of the recess 9 of the detonator when the detonator is located within the bore in its proper operational position. Injection of the settable locking material through the opening 12 results in the infiltration of the settable locking material around the recess 9, which in this case is the closure crimp of the detonator. Upon subsequent hardening of the settable locking material, the detonator is secured in position within the connector block. Preferably, the settable locking material may expand to form a tight friction fit with the inner surface of the bore. More preferably, the settable locking material may adhere to the inner surface of the bore upon setting. Since the detonator is accurately positioned relative to the slot before the settable locking material is injected into the bore, the surface of the percussion-actuation end of the detonator will be in optimal signal transfer relationship with the slot, and the shock tubes subsequently retained therein. Importantly, the inaccuracies of detonator positioning resulting from tolerance in the dimensions of the connector block and detonator, are virtually eliminated.

In an alternative embodiment, the housing is provided with two or more openings arranged around the recess 9 of the detonator contained therein. For example, FIG. 1*a* illustrates a second opening 18, on a side of the housing opposite the opening 12. Without wishing to be bound by theory, it is believed that the injection of a settable locking material through two or more openings may permit improved infiltration of the settable locking material around the recess 9. In this way, the detonator may be fixed more securely within the connector block.

Figure 1B:
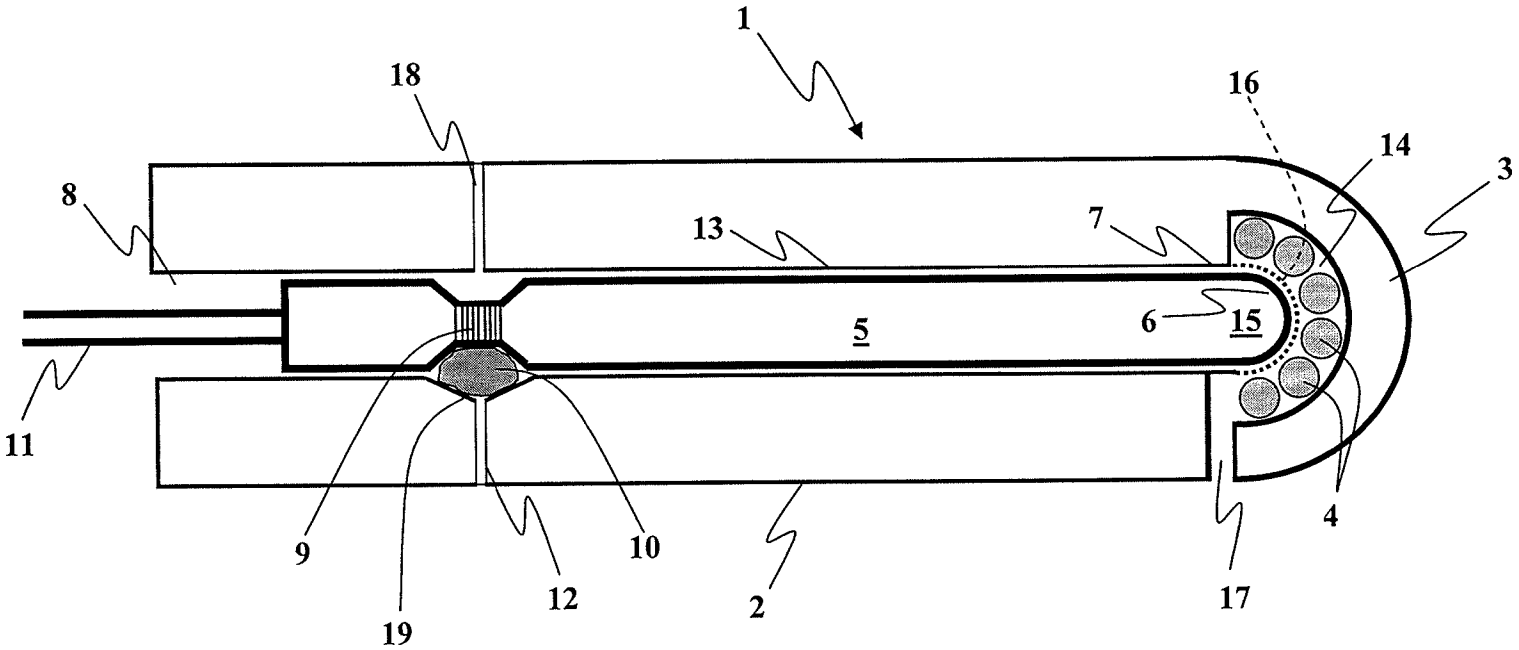
FIG. 1*b* is a cross-sectional view of a preferred embodiment of an assembly of the present invention comprising a connector block having a detonator mounted therein.

An alternative embodiment, similar to the embodiment shown in FIG. 1*a*, is illustrated in FIG. 1*b*. In accordance with FIG. 1*a*, the embodiment shown in FIG. 1*b* involves injection of a settable locking material 10 through at least one opening 12, and into the bore 13 in the vicinity of the recess 9 of the detonator 5. However, the bore has an alternative configuration in the vicinity of the recess of the detonator, when the bore is also provided with a recess 19. In this way the settable locking material engages both the recess 9 of the detonator 5 and the recess 19 of the bore 13, thereby assisting in fixing the detonator a desired position within the bore upon setting of the settable locking material 10.

Figure 2A:
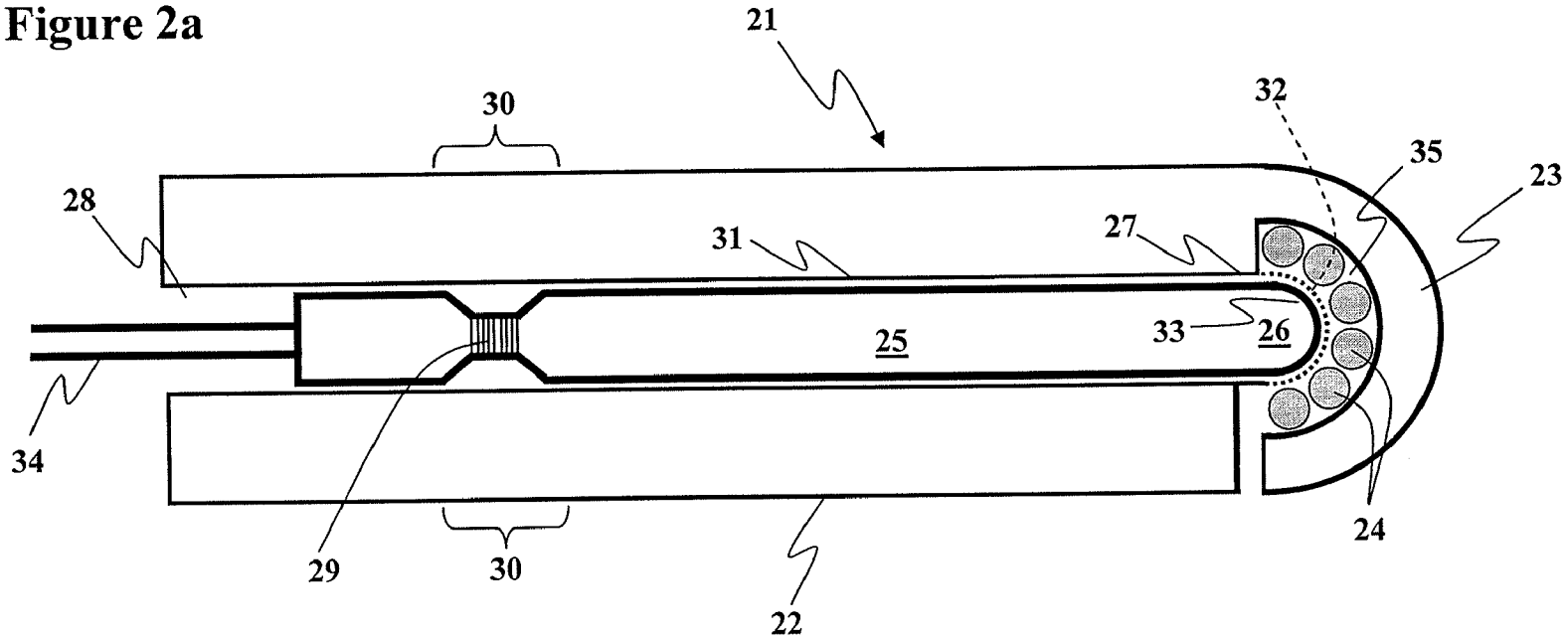
FIG. 2*a* is a cross-sectional view similar to that of FIG. 1*a* of an alternative embodiment of a connector block of the present invention, with a detonator mounted therein.
Figure 2B:
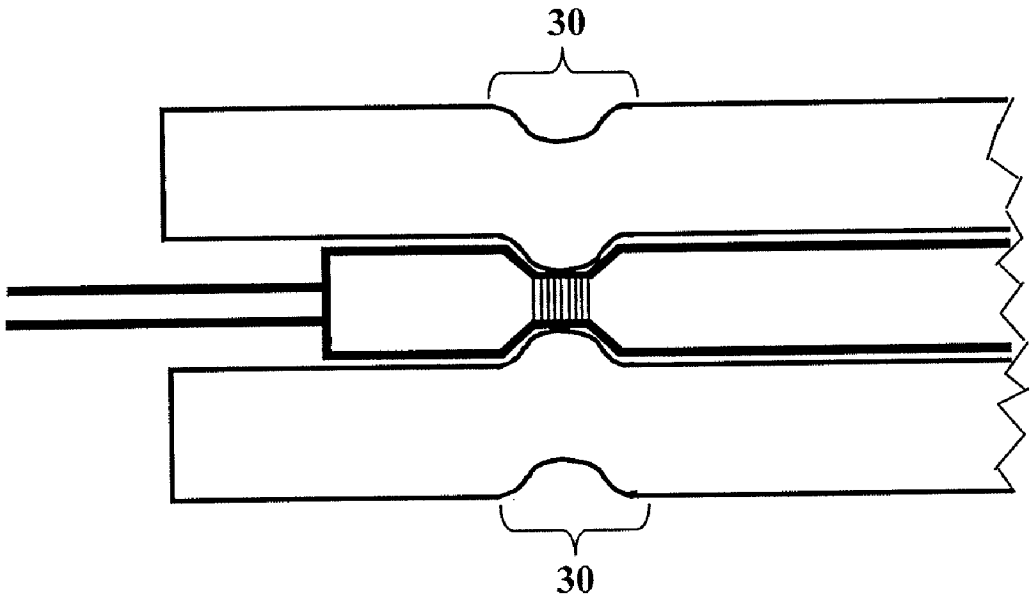
FIG. 2*b* is a cross-sectional view of part of the embodiment illustrated in FIG. 2*a* following a moulding operation to secure the detonator in the connector block to form an assembly according to a preferred form of the invention.

Another embodiment of the present invention is shown in FIGS. 2*a* and 2*b*. This embodiment encompasses a connector block 21 that comprises similar features to that shown in FIG. 1*a* and FIG. 1*b*, with the exception that the body of material is not injected, but is a region of softenable locking material integral with the housing. With reference to FIG. 2; the connector block 21 comprises a housing 22 with a bore 31 running longitudinally through the housing, the bore having a signal transmission end 27 and an open end 28. The connector block also comprises a shock tube retention means 23, that is integral with the housing and located at the signal transmission end of the bore.

The housing 22 is configured and dimensioned to receive a detonator 25 within the bore 31, in an appropriate orientation so that the percussion-actuation end 26 of the detonator 25 is adjacent to the signal transmission end of the bore. The detonator comprises an inwardly directed recess 29, which takes the form of a closure crimp. A detonator initiation shock tube 34 enters the bore via the open end. In one embodiment, the shock tube retention means 23 and the surface 33 of the percussion-actuation end of the detonator, define a slot 35. In this regard, shock tubes 24 can be located in the slot 35 and arranged around and in direct contact with the percussion actuation end 26 of the detonator 25. Preferably, the percussion-actuation end of the detonator is hemispherical, and therefore the shock tubes can be arranged equidistant from a base charge contained within the percussion-actuation end of the detonator.

The detonator 25 is positioned within the bore 31 of the housing 22 such that the surface of the percussion-actuation end of the detonator is optimally positioned relative to the position of the shock tubes. In an alternative embodiment, there is provided a positioning membrane 32 at the signal transmission end of the bore 27, for accurately locating the detonator within the connector block. In this regard, the detonator is inserted into the bore of the housing until the surface 33 of the percussion-actuation end of the detonator comes into contact with the positioning membrane 32. The positioning membrane may completely or partially close the signal transmission end of the bore, and is preferably shaped for intimate contact with the surface of the percussion-actuation end of the detonator. For example, the positioning membrane may comprise a spherical surface configured to receive a hemispherical end of a detonator.

In accordance with the embodiment of the invention shown in FIG. 2, the connector block is designed to secure the detonator therein by molding a portion of the housing 22 around the recess 29 of the detonator. For this purpose, the housing 22 of the connector block, at least in a region adjacent to the recess 29, comprises a region of softenable locking material 30 of suitable properties. Preferably, this region of softenable locking material 30 comprises a thermoplastic that may be readily softened by the application of thermal or ultrasonic energy to the surface of the housing. In an alternative embodiment of the present invention, the entire connector block may be molded out of the same thermoplastic material as the region of softenable locking material 30. Many settable plastic materials are known in the art to exhibit desirable thermoplastic properties suitable for this purpose. Particularly preferred plastic materials include polyethylene or polypropylene.

The softenable locking material can be molded around the recess of the detonator, as indicated in FIG. 2*b*. The housing becomes deformed around the recess, and once the softenable locking material becomes hardened, the detonator is secured in position within the connector block. The detonator is accurately positioned within the connector block before the region of softenable locking material is molded around the recess. In this way, the surface of the percussion-actuation end of the detonator can be optimally positioned relative to the slot, for efficient initiation of the shock tubes subsequently retained therein. The presence of the positioning membrane within the bore at the signal transmission end, may assist in the positioning of the detonator within the connector block.

The embodiment of the invention illustrated in FIG. 2 improves the reliability of shock tube initiation. The connector block illustrated in accordance with FIGS. 2*a* and 2*b* permits the positioning of the detonator within the block, wherein positioning inaccuracies resulting from tolerance are virtually eliminated.

Any device that can direct sufficient thermal or ultrasonic energy to soften the region of softenable locking material, may be used in accordance with the embodiment of the invention shown in FIG. 2. Several devices are known in the art, and include, for example, ultrasonic welders, hot air welders, heat staking machines, hot plate welders, infra red heaters, and lasers.

The application of ultrasonic energy is a particularly preferred means for softening the region of softenable locking material around the recess of the detonator. The use of ultrasonic devices represents a safer alternative to heating devices, since heating devices may include elements that increase the risk of burn injuries, and the controlled manner in which an ultrasonic welder is used is less likely to cause an inadvertent initiation of the detonator due to overheating.

Preferably, the application of thermal or ultrasonic energy is accompanied by the application of pressure to the surface of the housing. The application of pressure can assist in the molding of the softenable locking material around the recess of the detonator, and encourage the infiltration of the softenable locking material into the ridges of the closure crimp, as appropriate. In this way, the detonator may be held more securely within the connector block. The application of pressure may occur simultaneously with the application of ultrasonic or thermal energy, or may occur subsequent to the application of ultrasonic or thermal energy before the softenable locking material cools and hardens.

Preferably, the region of softenable locking material around the recess of the detonator comprises a thinner region of the housing, when compared to the rest of the housing. This confers several advantages to the connector block. Firstly, less thermal or ultrasonic energy is required to induce softening of the thinner region of the housing. Secondly, the thinner region of the housing will cool and harden more quickly following molding around the recess of the detonator. Thirdly, less pressure is required to assist in the molding process, since the malleability of the thinner region of the housing is increased. In combination, these factors can result in an increased speed and efficiency of production of the corresponding connector block/detonator assemblies.

Figure 3:
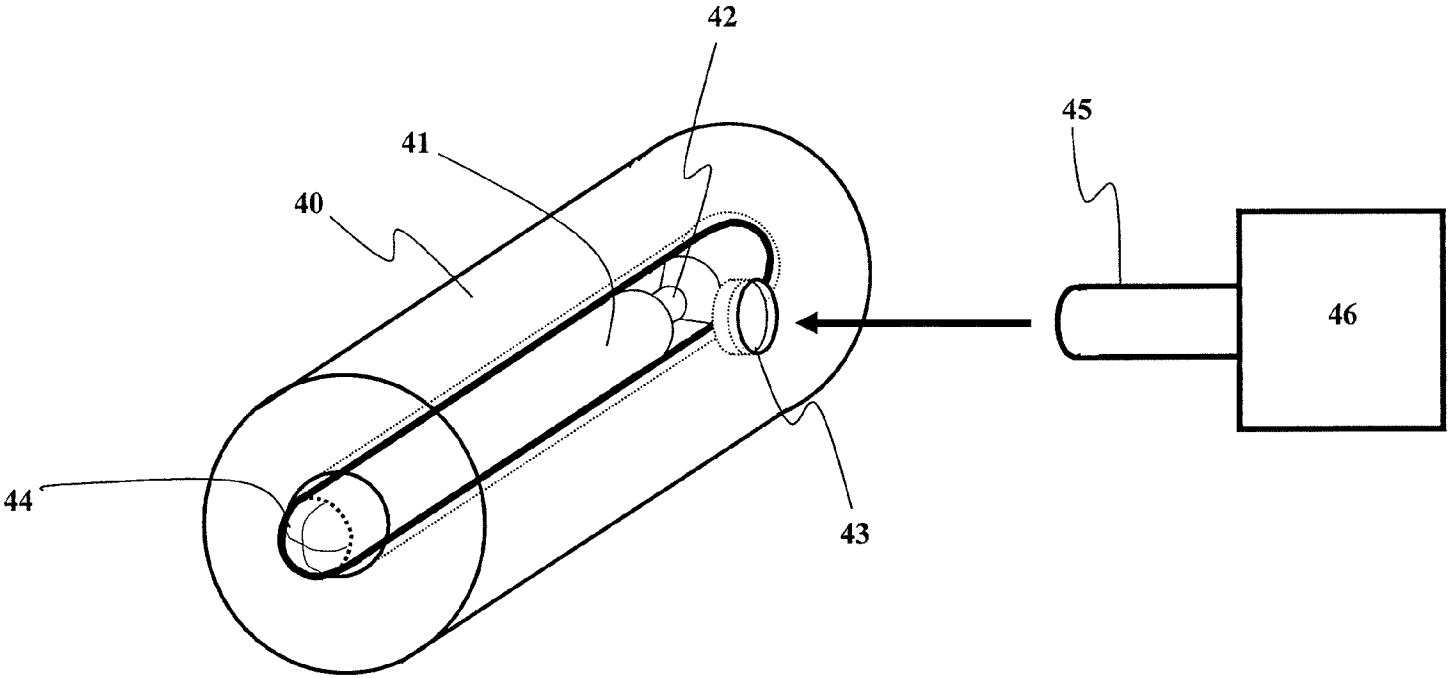
FIG. 3 is a perspective view of an embodiment of a connector block of the present invention with an associated device and probe for the application of ultrasonic or thermal energy.

Preferably, the thinner region of the housing takes the form of a recess in the wall of the housing, adjacent to the recess of the detonator. This embodiment of the connector blocks of the present invention is illustrated in FIG. 3, which shows a perspective view of a part of a preferred connector block of the present invention, with a detonator located therein. For simplicity, the housing is indicated as a cylindrical structure, and the end of the connector block comprising the shock tube retention means is not shown. The housing 40 contains a bore 44 running longitudinally through the housing. A detonator 41 is inserted into the bore, and preferably positioned with the surface of the percussion-actuation end of the detonator in optimal signal transfer relationship with the slot for retaining shock tubes therein (not shown in FIG. 3).

The housing of the connector block includes a closed-ended recess 43 located approximately adjacent to the recess of the detonator, which defines a region of the housing comprising a softenable locking material. The recess in the housing is dimensioned and configured to receive a probe 45 of a device 46 that generates thermal or ultrasonic energy. The probe is inserted into the recess of the housing, and the subsequent application of thermal or ultrasonic energy softens the softenable locking material, thus inducing the molding of the softenable locking material around the recess of the detonator. Preferably, the molding of the softenable locking material is assisted by the application of pressure, either simultaneously with the application of thermal or ultrasonic energy, or after the application of the thermal or ultrasonic energy, before the softenable locking material cools and hardens. Preferably, the end of the probe 45 is concave in shape, to assist in the molding of the softenable locking material around the recess. The housing may comprise more than one recess, so that ultrasonic or thermal energy and pressure as required can be applied to more than one side of the housing. In this way, the detonator may be held more securely within the connector block.

Although less preferred, the application of ultrasonic or thermal energy from probe 45 to recess 43 may induce a thin layer of the material of recess 43 to heat sufficiently to temporarily liquify the material. Whilst liquification of the material is generally not a requirement to induce material softening and plastic flow, the inventors have noted that liquification of the material does not inhibit the methods of the present invention, nor reduce the capacity to secure a detonator within a connector block.

The present invention also encompasses a method for the production of an assembly comprising a detonator secured within a connector block in accordance with the present invention. The method includes a first step of inserting the detonator into the connector block. In this regard, the detonator must be inserted into the bore of the housing of the connector block, oriented so that the percussion-actuation end of the detonator is directed towards the signal transmission end of the bore. Therefore, the detonator is inserted percussion-actuation end first, into the open end of the bore.

The method of the present invention also provides for the positioning of the detonator within the connector block. The step of positioning may occur subsequently, or simultaneously with the step of inserting the detonator into the connector block. The positioning step ensures that the surface of the percussion-actuation end of the detonator is in optimal signal transfer relationship with the slot, and the shock tubes subsequently retained therein. In one embodiment, the slot is defined by the shock tube retention means and the surface of the percussion-actuation end of the detonator. In an alternative embodiment, the slot is defined by the shock tube retention means and the positioning membrane located within the signal transmission end of the bore. In the later embodiment, the positioning of the detonator within the connector block is assisted by the positioning surface, wherein the surface of the percussion-actuation end of the detonator is in signal transfer relationship with the positioning surface, and the positioning membrane is in signal transfer relationship with the shock tubes subsequently retained in the slot. Preferably, the percussion-actuation surface of the detonator is hemispherical, and the slot defines a space around the hemispherical percussion-actuation end of the detonator for the retention of shock tubes. The step of positioning the detonator within the connector block ensures that the percussion-actuation end of the detonator is located for optimal energy transmission from the base charge within the detonator to the shock tubes retained by the connector block.

The method also includes the step of securing the correctly positioned detonator within the connector block. For this purpose, the method provides for causing a body of material to flow plastically into the recess of the detonator, and harden to form a locking element fixed to the housing. In accordance with the connector blocks of the present invention, the step of securing may be achieved by any one of several ways. Importantly, potential variation in the positioning of the percussion-actuation end of the detonator resulting from tolerance in the connector block, is preferably virtually eliminated.

In a preferred embodiment of the method of the present invention, the step of securing comprises injecting a settable locking material in a molten form through at least one hole or opening in the side of the housing of the connector block. The opening or openings are located in the proximity of the recess of the detonator contained therein. In this way, the settable locking material in a liquid state infiltrates the bore of the housing and partially or completely surrounds the recess of the detonator. Subsequent cooling and hardening of the settable locking material secures the detonator in the required position, with the surface of the percussion-actuation end of the detonator remaining in optimal signal transfer relationship with the slot for the retention of the shock tubes. Preferably, the bore also includes a recess adjacent the recess in the detonator, so that the settable locking material infiltrates and hardens within both the recess on the detonator and the recess in the bore, further improving the securing of the detonator within the connector block.

In an alternative preferred embodiment of the method of the present invention, the step of securing involves molding a portion of the housing around the recess of the detonator contained therein. For this purpose, thermal or ultrasonic energy is preferably applied to the surface of the housing in the proximity of the recess. This region of the housing comprises a softenable locking material preferably of a suitable thermoplastic, which softens upon heating. Many thermoplastics are known in the art that are suitable for use in this regard. Preferably, the thermal or ultrasonic energy is applied to a region of the housing that is generally thinner that the overall thickness of the material of the connector block. More preferably, the thinner region of the housing comprises a recess in the proximity of the recess of the detonator, suitable for accepting a probe for applying ultrasonic or thermal energy to the surface of the connector block. The connector block may be provided with more than one recess for the application of ultrasonic or thermal energy at more than one position around the recess of the detonator. Preferably, the application of ultrasonic or thermal energy is accompanied by the application of pressure, to assist in the molding of the softenable locking material into the recess. Following the molding of the softenable locking material around the recess of the detonator, the softenable locking material is allowed to cool and harden, thereby securing the detonator at the desired position within the connector block.

The present invention also encompasses the connector block/detonator assemblies obtainable by the production methods of the present invention.

While the invention has been described for use with shock tube and with reference to particular preferred embodiments thereof, it will be apparent to those skilled in the art upon a reading and understanding of the foregoing that numerous connector block designs, connector block/detonator assemblies, and methods for their assembly other than the specific embodiments illustrated are attainable, which nonetheless lie within the spirit and scope of the present invention. Moreover, the connector blocks of the present invention may be adapted for use with low energy detonation cord instead of shock tube. It is intended to include all such designs, assemblies, assembly methods, and equivalents thereof within the scope of the appended claims.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference to any prior art in this specification is not, and should not be taken as, an acknowledgment or any form of suggestion that that prior art forms part of the common general knowledge.

The invention claimed is:

1. A method of producing an assembly of a connector block and a detonator suitable for retaining at least one shock tube adjacent to a percussion-actuation end of the detonator, the method comprising inserting a detonator into a connector block, said detonator having a percussion-actuation end and an outer wall provided with an inwardly directed recess at a position remote from said percussion-actuation end, and said connector block having a housing provided with a bore for receiving said detonator, as well as a shock tube retention means provided on the housing at an end of the bore adjacent to the percussion-actuation end of the detonator, said shock tube retention means defining with said housing a slot for receiving at least one shock tube and holding said at least one shock tube adjacent to the percussion-actuation end of the detonator; positioning the detonator in the bore of said housing so that the percussion-actuation end is positioned adjacent to said slot; and fixing the detonator in the housing; wherein the detonator is fixed in the housing by causing a body of material to flow plastically into said recess in the detonator and to harden therein to form a locking element fixed to said housing, thereby preventing accidental movement of said detonator within said connector block.

2. A method according to claim 1, wherein the step of causing the body of material to flow plastically into said recess comprises: applying ultrasonic or thermal energy to the region of the housing adjacent to the recess in the detonator, applying inwardly directed pressure to the said region to cause a part of the housing to flow as said body into said recess; and allowing said body of material to harden in said recess.

3. A method of claim 2, wherein the ultrasonic or thermal energy is applied using an ultrasonic or thermal device, said device comprising a probe for applying said ultrasonic or thermal energy to the housing.

4. The method of claim 2 or claim 3, wherein said pressure is applied simultaneously with the ultrasonic or thermal energy.

5. The method of claim 2 or claim 3, wherein said pressure is applied subsequently to the ultrasonic or thermal energy, before the body of material hardens.

6. A method according to claim 1, wherein the step of causing the body of material to flow plastically into said recess comprises injecting the body of material in a fluid state through at least one hole passing through a wall of the housing located adjacent to the recess of the detonator located therein, the body of material being injected into said recess; and hardening the body of material in said recess.

7. The method of claim 6, wherein the body of material is injected through two holes on opposite sides of the housing.

* * * * *